US006553951B2

(12) United States Patent
Ogawa

(10) Patent No.: US 6,553,951 B2
(45) Date of Patent: Apr. 29, 2003

(54) VALVE TIMING REGULATION DEVICE FOR INTERNAL COMBUSTION ENGINES

(75) Inventor: Kazumi Ogawa, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/774,071

(22) Filed: Jan. 31, 2001

(65) Prior Publication Data

US 2001/0022164 A1 Sep. 20, 2001

(30) Foreign Application Priority Data

Jan. 31, 2000 (JP) ..... 2000-022498

(51) Int. Cl.[7] ..... F01L 1/34
(52) U.S. Cl. ..... 123/90.17; 74/568 R; 464/2
(58) Field of Search ..... 123/90.15, 90.17, 123/90.31; 74/568 R; 464/1, 2, 160

(56) References Cited

U.S. PATENT DOCUMENTS

| | | | | | |
|---|---|---|---|---|---|
| 5,775,279 | A | * | 7/1998 | Ogawa et al. | 123/90.17 |
| 6,053,139 | A | * | 4/2000 | Eguchi et al. | 123/90.17 |
| 6,058,897 | A | * | 5/2000 | Nakayoshi | 123/90.17 |
| 6,062,182 | A | * | 5/2000 | Ogawa | 123/90.17 |
| 6,085,708 | A | * | 7/2000 | Trzmiel et al. | 123/90.17 |
| 6,244,230 | B1 | * | 6/2001 | Mikame | 123/90.17 |

FOREIGN PATENT DOCUMENTS

| | | |
|---|---|---|
| DE | 198 29 049 A1 | 1/1999 |
| DE | 197 56 015 A1 | 6/1999 |
| DE | 198 60 025 A1 | 7/1999 |
| DE | 199 03 624 A1 | 8/1999 |
| JP | 9-264110 | 10/1997 |
| JP | 11-294121 | 10/1999 |

* cited by examiner

*Primary Examiner*—Weilun Lo
(74) *Attorney, Agent, or Firm*—Burns, Doane, Swecker & Mathis, LLP

(57) ABSTRACT

The present invention provides a valve timing regulating device which controls the opening/closing timing of an exhaust valve of an internal engine combustion engine so that upon starting the engine a rotor member is rotated relative to a housing member for reaching in shorter time duration a region in which a lock mechanism functions. The valve timing regulation device includes a fluid pressure circuit controlling the supply and drainage of operating fluid to and from each of the advance angle fluid chamber and the retard angle fluid chamber. The fluid pressure circuit has a fluid pump driven by the internal combustion engine, a control valve controlling, by adjusting the operating fluid supplied from the fluid pump, the supply and draining of operating fluid to and from each of the advance angle fluid chamber and the retard angle fluid chamber, and a check valve disposed between the control valve and the fluid pump such that the check valve is placed close to the control valve for preventing entrance of the operating fluid into the fluid pump.

19 Claims, 8 Drawing Sheets

VALVE TIMING REGULATION DEVICE FOR INTERNAL COMBUSTION ENGINES

This application is based on and claims priority under 35 U.S.C. § 119 with respect to Japanese Application No. 2000-022498 filed on Jan. 31, 2000, the entire content of which is incorporated herein by reference.

FIELD OF THE INVENTION

The present invention generally relates to internal combustion engines. More particularly, the present invention pertains to a valve timing regulation device that controls the opening and closing timing of the valve in an internal combustion engine valve system.

BACKGROUND OF THE INVENTION

One example of a known valve timing regulation device is disclosed in Japanese Patent Laid-Open Publication No. Hei. 11(1999)-294121. This valve timing regulation device includes a housing member placed in a driving force transmission path which transmits a driving force from the driving shaft (i.e., crank shaft) of an internal combustion engine to a driven shaft (i.e., cam shaft) for opening and closing an exhaust valve of the internal combustion engine. The housing member is adapted to rotate together with one of the driving shaft and the driven shaft. A rotor member is assembled to a shoe portion of the housing member so as to be rotated relative thereto, and the rotor member has a vane portion which divides an advance angle fluid chamber and a retard angle fluid chamber in the housing member. The rotor member is adapted to rotate together with the other of the driving shaft and the driven shaft. A fluid pressure circuit controls the supply and drainage of an operating fluid to and from each of the advance angle fluid chamber and the retard angle fluid chamber.

This valve timing regulation device further includes a lock mechanism controlled by the fluid pressure circuit and a torsion spring. The lock mechanism prevents relative rotation between the housing member and the rotor member at the most advance angle region. The torsion spring is interposed between the housing member and the rotor member for urging the rotor member in an advancing direction relative to the housing member.

However, in this known valve timing regulation device, although the rotor member is adapted to rotate relative to the housing member for advancing the angular position of the driven shaft relative to the driving shaft, in cases where, for example, the resistance of the passage ranging from the engine driven fluid pump to the advance angle fluid chamber is very high or where the operation fluid possesses a high viscosity (e.g., the operation fluid possesses a low temperature), during a transition period at initiation of the internal combustion engine the pressure of the operating fluid supplied from the fluid pump to the advance angle fluid chamber increases to a predetermined value, it is possible that the rotor member may not correctly rotate relative to the housing member, to the most advance angle region at which the lock mechanism functions. The resulting phenomena prolongs the overlap period under which the intake and exhaust valves of the internal combustion engine open concurrently, thereby not obtaining a normal burn in the internal combustion engine upon start thereof.

Thus, a need exists for a valve timing regulation device which is not as susceptible to the foregoing disadvantages and difficulties.

SUMMARY OF THE INVENTION

According to one aspect of the invention, a valve timing regulation device includes a housing member, a rotor member, a lock mechanism and a fluid control circuit. The housing member is positioned in a driving force transmission path in which a driving force is transmitted from a driving shaft of an internal combustion engine to a driven shaft for opening and closing a valve of the internal combustion engine, with the housing member being rotatable together with one of the driving shaft and the driven shaft. The rotor member is assembled to a shoe portion of the housing member and is rotatable relative to the housing member. The rotor member has a vane portion dividing the interior of the housing member into an advance angle fluid chamber and a retard angle fluid chamber. The rotor member is rotatable together with the other of the driving shaft and the driven shaft. The lock mechanism regulates the relative rotation between the housing member and the rotor member at a region other than a most retard angle region. The fluid pressure circuit controls the supply and drainage of an operating fluid to and from each of the advance angle fluid chamber and the retard angle fluid chamber. The fluid pressure circuit includes a fluid pump driven by the internal combustion engine, a control valve which controls, by adjustment of the operating fluid supplied from the fluid pump, the supply and drainage of the operating fluid to and from each of the advance angle fluid chamber and the retard angle fluid chamber, with the control valve controlling the lock and unlock of the lock mechanism, and a check valve disposed between the control valve and the fluid pump such that the check valve is positioned close to the control valve for preventing entrance of the operating fluid into the fluid pump.

According to another aspect of the invention, a valve timing regulating device includes a housing member, a rotor member, a chamber disposed between the housing member and the rotor member, a dividing member dividing the chamber into an advance angle fluid chamber and a retard angle fluid chamber, a fluid pressure supplying device that supplies operation fluid to the advance angle fluid chamber and/or the retard angle fluid chamber respectively, a regulating member that regulates the operation fluid supplied to the advance angle fluid chamber and/or the retard angle fluid chamber, and a preventing device that prevents the operating fluid from being drained from one of the advance chamber or the retard chamber.

According to a still further aspect of the present invention, a valve timing regulation device includes a housing member, a rotor member, a lock mechanism, a fluid pump, a control valve and a check valve. The housing member is positioned in a driving force transmission path in which a driving force is transmitted from a driving shaft of an internal combustion engine to a driven shaft for opening and closing a valve of the internal combustion engine, with the housing member being rotatable together with one of the driving shaft and the driven shaft. The rotor member is positioned within the housing and is rotatable together with the other of the driving shaft and the driven shaft to rotate relative to the housing. The rotor member includes a plurality of vane portions dividing the interior of the housing member into a plurality of advance angle fluid chambers and a plurality of retard angle fluid chambers. The lock mechanism prevents relative rotation between the housing member and the rotor member. The fluid pump is driven by the internal combustion engine to pump operating fluid into the advance angle fluid chambers and the retard angle fluid chambers, and the control valve is positioned between the pump and the advance and retard angle fluid chambers to control supply and drainage of the operating fluid to and from each of the advance and retard angle fluid chambers. The check valve is disposed between the control valve and the fluid pump at a location closer to the control valve than the fluid pump to prevent entrance of the operating fluid into the fluid pump.

With the present invention, in the transition period in which the pressure of the operating fluid outputted from the fluid pump (fluid pressure supplying means) toward the advance angle fluid chamber increases to the predetermined value when the internal combustion engine is initiated or started, the torque fluctuation transmitted from the valve to the driven shaft (and the rotor member) causes repetitive relative rotations between the housing member and the rotor member. Thus, the vane (the dividing member) changes the volume of the advance and retard angle fluid chambers repetitively. The resulting repetitive pressure (negative pressure) changes in the advance and retard angle fluid chambers and the function of the check valve (the preventing means) prevents the operation fluid from being drained from the advance or retard angle fluid chamber to the fluid pump (the fluid supplying means), and establishes pumping action (sucking action) which results in repetitive suctions of the operating fluid into the advance or retard angle fluid chamber by way of the check valve (the preventing means) and the control valve (the regulating member), thereby storing the operating fluid in the advance or retard angle fluid chamber in a stepwise manner.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
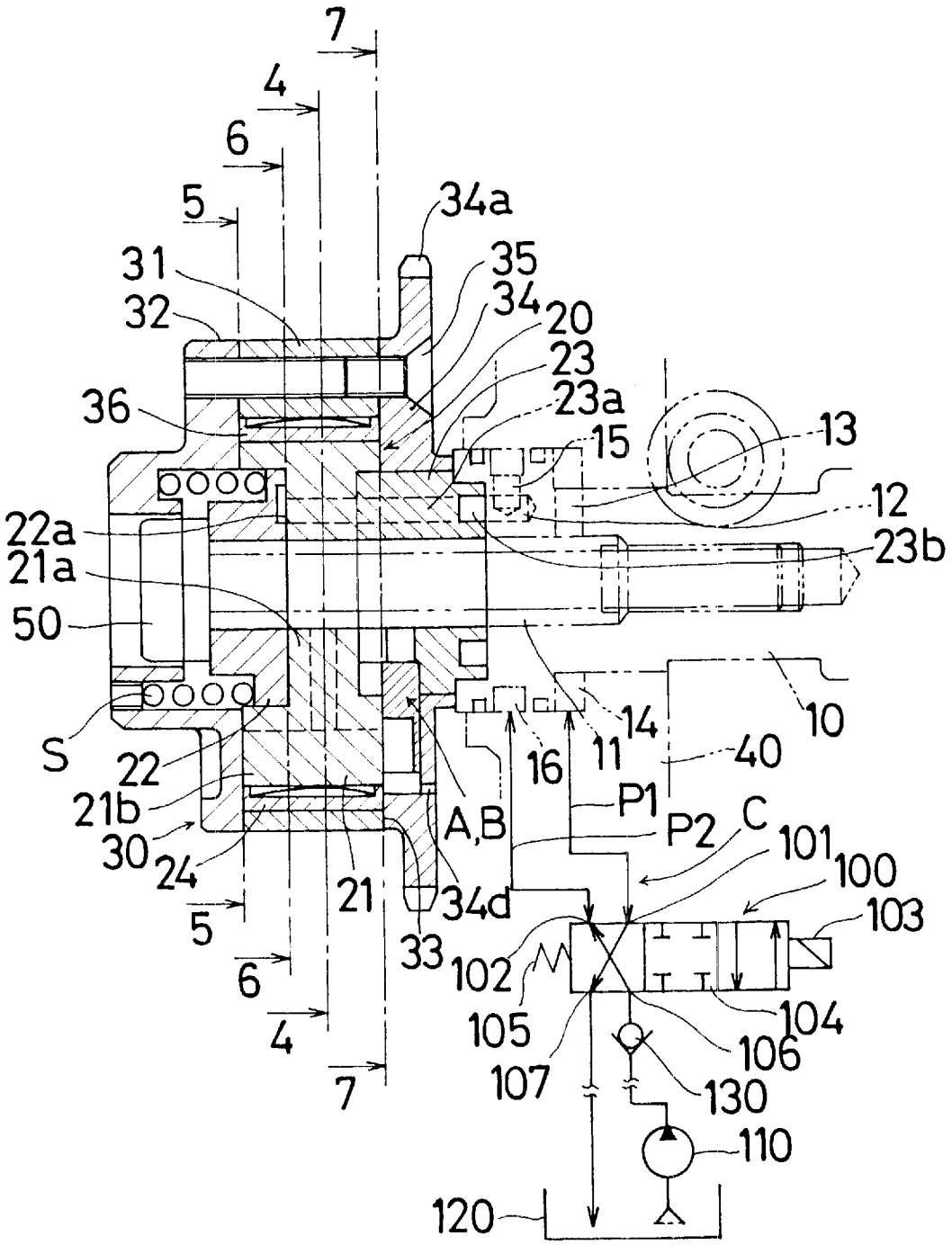
FIG. 1 is a cross-sectional view of a valve timing regulation device in accordance with a first embodiment of the present invention, taken along the section line 1—1 in FIG. 3.
Figure 2:
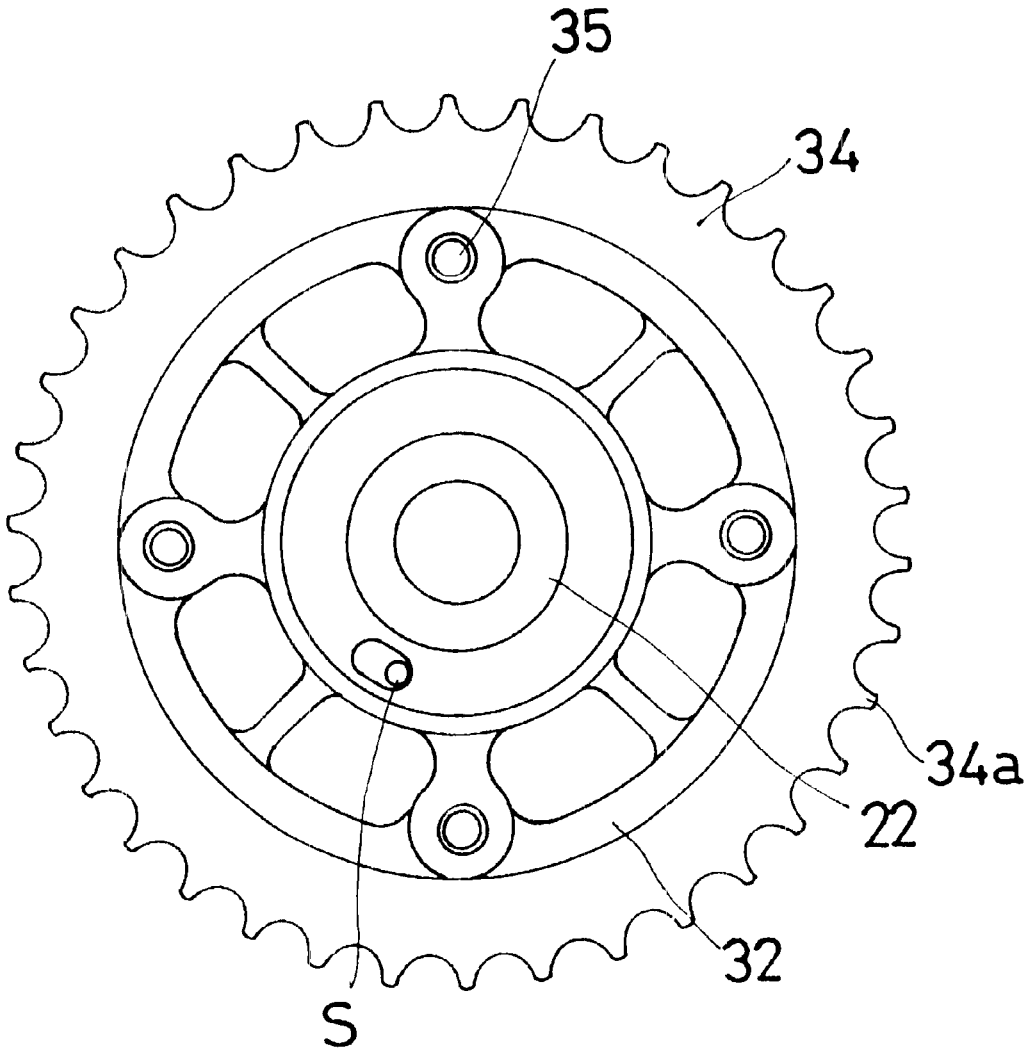
FIG. 2 is a front view of the valve timing regulation device illustrated in FIG. 1.

Referring initially to FIG. 1, the valve timing regulation device of the present invention includes a cam shaft 10 whose distal end portion is fixedly connected with a rotor member 20, a housing 30 in which is accommodated the rotor member 20 such that relative rotation between the rotor member 20 and the housing member 30 is allowed within an angular range, a torsion spring S interposed between the rotor member 20 and the housing member 30 to urge the rotor member 20 in an advancing direction relative to the housing member 30, a stopper mechanism A which defines the most advanced and most retarded angular positions (phases) of the rotor member 20 relative to the housing member 30, a lock mechanism B which prevents relative rotation between the housing member 30 and the rotor member 20 when the rotor member 20 is at the most advanced angular position, and a fluid pressure circuit C which controls the supply and drainage of operating fluid or oil to an advancing angle fluid chamber R1 as well as a retarded angle fluid chamber R2. The fluid pressure circuit C also controls the locking and unlocking operations of the lock mechanism B.

Cams that are well known to skilled artisans are mounted on the cam shaft 10. These cams area adapted to open and close exhaust valves (not shown). The cam shaft 10 is rotatably supported on a cylinder head 40 of an internal combustion engine. Inside the cam shaft 10, a retard angle passage 11 and an advance angle passage 12 are provided, and these passages extend in the axial direction of the cam shaft 10. The retard angle passage 11 is in fluid communication with a connection port 101 of a changeover valve 100 by way of a radially extending passage 13, an annular passage 14, and a connecting passage P1, while the advance angle passage 12 is in fluid communication with a connection port 102 of the changeover valve 100 by way of a radially extending passage 15, an annular passage 16, and a connecting passage P2. The radially extending passage 13, the radially extending passage 15, and the annular passage 16 are formed in the cam shaft 10. The annular passage 14 is defined between a stepped portion of the cam shaft 10 and a stepped portion of the cylinder head 40.

The changeover valve 100 constitutes a part of the fluid pressure circuit C together with other features such as a fluid pump 110, a fluid pan 120, and a check valve 130. The changeover valve 100 includes a solenoid 103. When the solenoid 103 is energized, a spool 104 of the changeover valve 100 is moved in the leftward direction in FIG. 1 against the urging force of a spring 105. When the solenoid 103 is not energized, a supply port 106 which is connected to the fluid pump 110 which is driven by the internal combustion engine is brought into fluid communication with the connecting port 102, and the connecting port 101 is brought into fluid communication with a drain port 107 which is connected to the fluid pan 120. When a first amount of current (first predetermined amount of current) is supplied to the solenoid 103 to cause the changeover valve to move leftward, the supply port 106 is isolated from the connecting port 101 and the drain port 107 is isolated from the connecting port 102. When a second amount of current larger than the first amount of current (second predetermined amount of current) is supplied to the solenoid 103 to cause the changeover valve to move further leftward, the supply port 106 fluidly communicates with the connecting port 101 and the connecting port 102 fluidly communicates with the drain port 107.

Thus, when the solenoid 103 is not energized, the operating fluid is supplied from the fluid pump 110 to the advance angle fluid passage 12 and is drained from the retard angle passage 11 to the fluid pan 120. When the solenoid 103 is supplied with the first predetermined amount of current, the operating fluid is retained in each of the retard angle passage 11 and the advance angle passage 12. Further, when the solenoid 103 is supplied with the second predetermined amount of current, the operating fluid is supplied from the fluid pump 110 to the retard angle passage 11 and is drained from the advance angle passage 12 to the fluid pan 120.

The fluid pan 120, which is in the form of an oil pan of the internal combustion engine, reserves the operating fluid which is also used for cooling and lubricating the internal combustion engine. The check valve 130, which prevents fluid from flowing into the fluid pump 100, is disposed between the changeover valve 100 and the fluid pump 110, with the check valve 130 being placed close to the changeover valve 100.

The rotor member 20 is comprised of a main rotor 21, a front rotor 22 and a rear rotor 23. The front rotor 22 has a stepped cylinder shape and is fixedly connected to the front end (i.e., left side in FIG. 1) of the main rotor 21. The rear rotor 23 has a stepped cylinder shape and is fixedly connected to the rear end (i.e., right side in FIG. 1) of the main rotor 21. The rotor member 20 is fixedly connected, by way of a screw bolt 50, to the front distal end of the cam shaft 10. The inner bores of the respective rotors 21, 22, 23 whose front ends are closed by the head of the bolt 50 are in fluid communication with the retard angle passage 11 inside the cam shaft 10.

Figure 4:
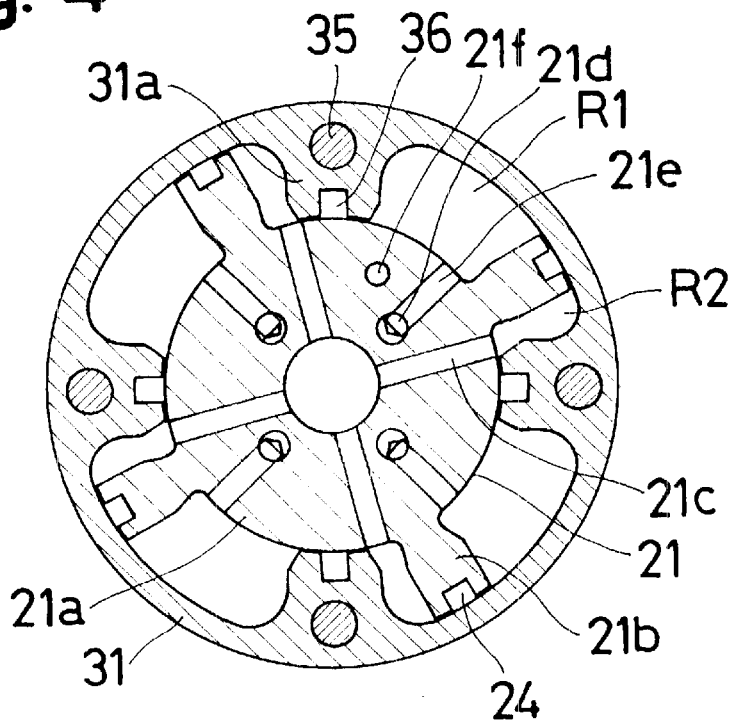
FIG. 4 is a cross-sectional view of the valve timing regulation device taken along the section line 4—4 in FIG. 1, with the sprocket omitted.
Figure 5:
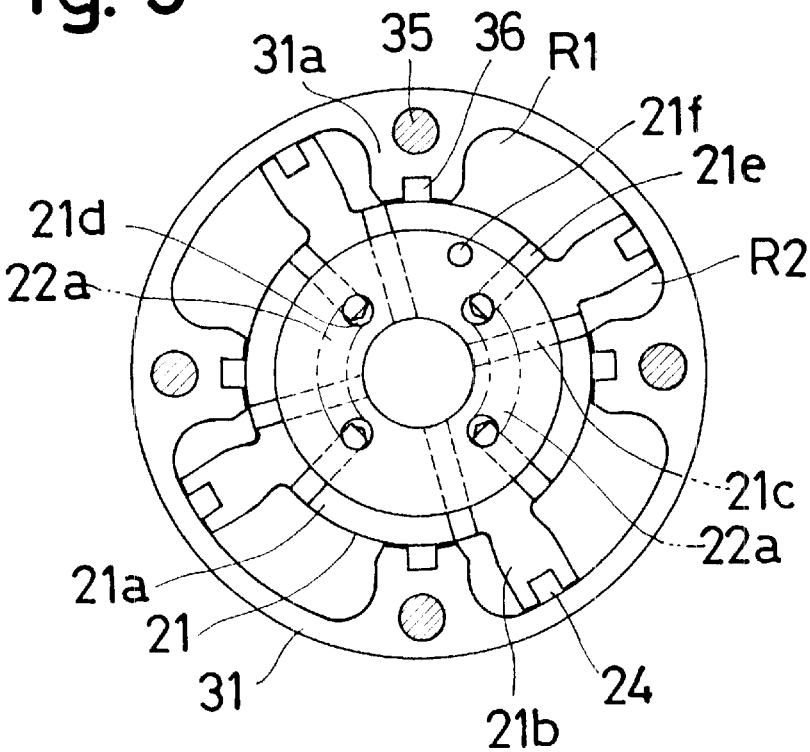
FIG. 5 is a cross-sectional view of the valve timing regulation device taken along line 5—5 in FIG. 1 with the sprocket and the front rotor omitted.
Figure 6:
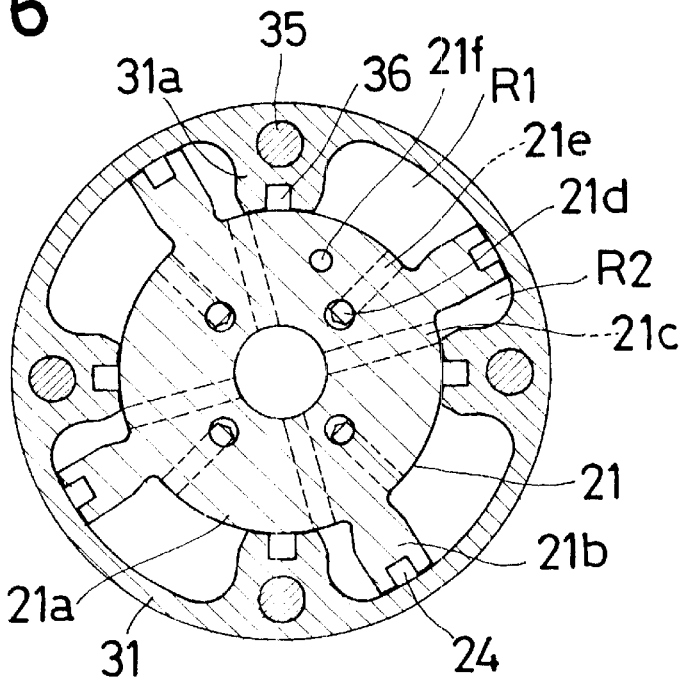
FIG. 6 is a cross-sectional view of the valve timing regulation device taken along the section line 6—6 in FIG. 1, with the sprocket omitted.

As shown in FIGS. 4–6, the main rotor 21 includes a hub portion 21*a* and four vane portions 21*b*. The hub portion 21*a* is connected at its opposite ends, in co-axial alignment with the front rotor 22 and the rear rotor 23. The vane portions 21*b* extend from the hub portion 21*a* in a radially outwardly directed manner in the housing member 30, and divide the interior of the housing member into four advance angle fluid chambers R1 and four retard angle fluid chamber R2 that are alternately arranged. A sealing member 24 is provided at the distal end of each of the vane portions 21*b* for ensuring a fluid-tight relationship between the adjacently positioned advance angle fluid chamber R1 and retard angle fluid chamber R2.

Four radially extending passages 21*c* are formed in the hub portion 21*a* of the main rotor 21. Each of the four radially extending passages 21*c* establishes fluid communication between the corresponding retard angle fluid chamber R2 and the center bore of the main rotor 21. Four axially extending passages 21*d* are also formed in the hub portion 21*a*. Each of these axially extending passages 21*d* is in fluid communication with the advance angle passage 12 and each is in fluid communication with a corresponding advance angle fluid chamber R1 by way of a radially extending passage 21*e*.

Figure 3:
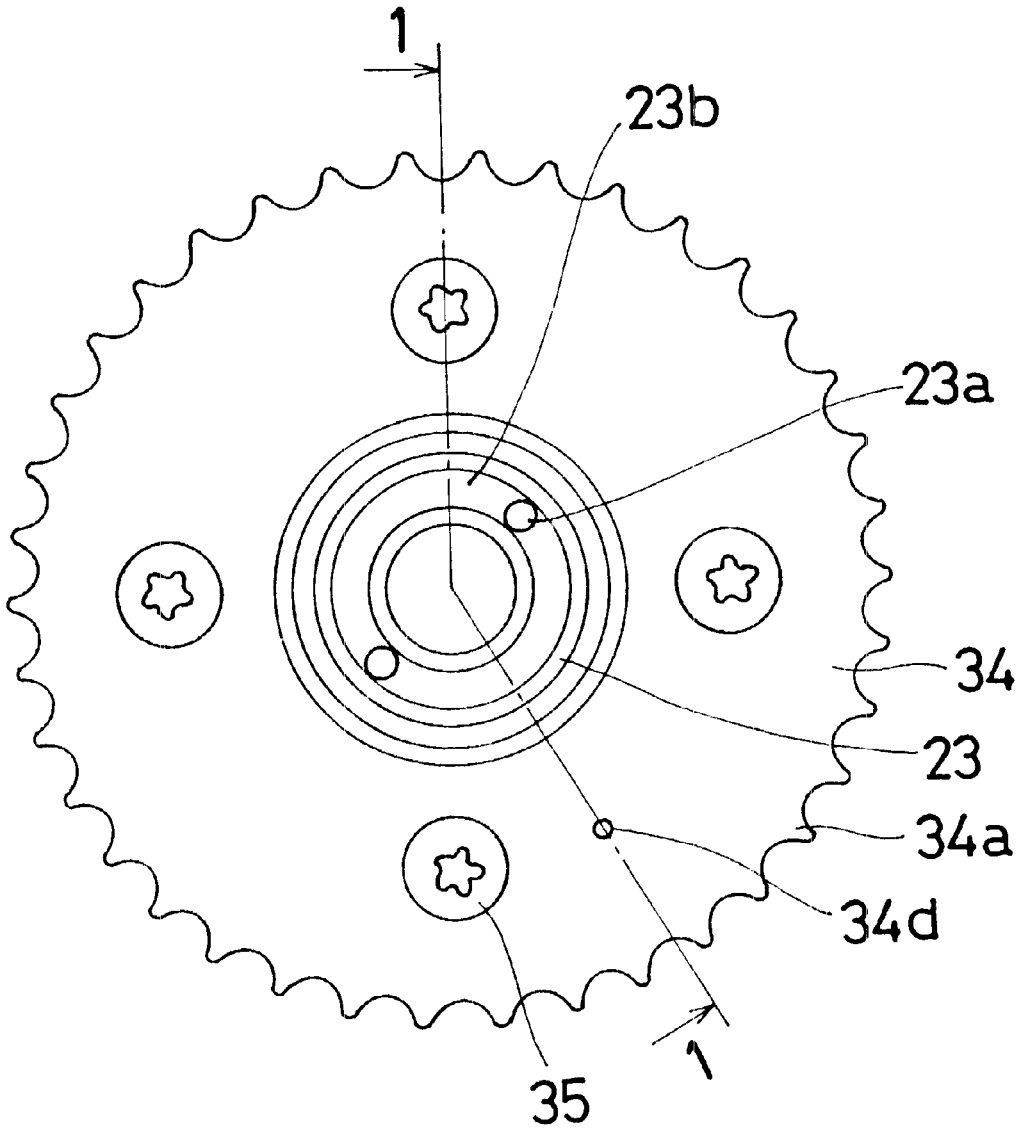
FIG. 3 is a rear view of the valve timing regulation device illustrated in FIG. 1.

Two of the four axially extending passages 21*d* (i.e. the passages positioned at the upper-left and the lower-right portions in each of FIGS. 4–6) pass through the main rotor 21 and are in fluid communication with the advance angle passage 12 by way of the axial passage 23*a* in the rear rotor 23 and the annular passage 23*b* (FIGS. 1 and 3). The two other opposing passages 21*d* (i.e. the passages 21*d* positioned at the upper-right and the lower-reft portions in each of FIGS. 4–6), which are open only at the front side of the main rotor 21, are in fluid communication with the aforementioned axially extending passages 21*d*, respectively, by way of arc-shaped passages 22*a* formed in the rear surface of the front rotor 22. It is to be noted that an axially extending hole 21*f* which is seen at the upper portion in each of FIGS. 4–6 is adapted to receive a pin (not shown) that connects the main rotor 21 and the front rotor 22.

The housing member 30 is made up of a housing main body 31, a front plate 32, a rear thin plate 33, and a rear thick plate 34 which are connected as a unit by four bolts 35. A sprocket 34*a* is integrally formed along the outer periphery of the rear thick plate 34. This sprocket 34*a* is connected by way of a timing chain (not shown) to the internal combustion engine crank shaft (not shown) for receiving a driving force from the internal combustion engine crank shaft.

As shown in FIGS. 4–6, two pairs of shoe portions 31*a* (i.e. four shoe portions 31*a* in total) are provided in the housing main body 31. The shoe portions 31*a* extend inwardly in the radial direction. The housing main body 31 rotatably supports the hub portion 21*a* of the main rotor 21 by way of sealing members 36 which are provided at radially inwardly facing end of the shoe portions 31*a*. The opposite axial end surfaces of each of the hub portion 21*a* of the main rotor 21, the vane portions 21*b* of the main rotor 21, and the sealing members 36 are in sliding engagement with respective opposing axial end surfaces of the front plate 32 and the rear thin plate 33.

Considering the housing member 30 in more detail, the housing main body 31 and the front plate 32 constitute a cylinder having a rear end (i.e., the right end in FIG. 1) and a front end that are open and closed, respectively and whose inside portion constitutes an accommodating portion for receiving the rotor member 20. The rear thin plate 33 cooperates with the rear thick plate 34 which is in the form of a substantially flat plate to constitute a cover member which is adapted to close the open end of the accommodating portion.

Figure 7:
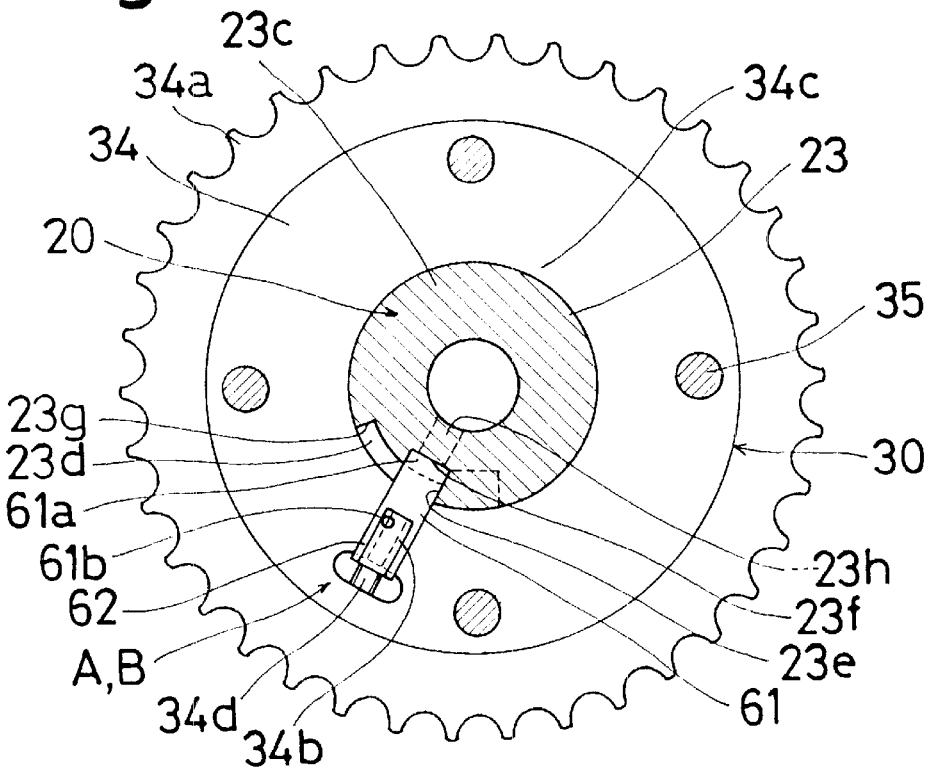
FIG. 7 is a cross-sectional view taken the section line 7—7 in FIG. 1.

As can be seen from FIGS. 1 and 7, the rear thick plate 34 includes a hub portion 34*c* in which an accommodating groove 34*b* is formed. The accommodating groove 34*b* is configured to be open in the frontward direction and radially inwardly, with the frontward opening being closed by the rear thin plate 33. The rear thick plate 34 is, at the hub portion 34*b*, rotatably mounted on the rear rotor 23 which extends from the opening of the housing member 30. A lock key 61 and a lock spring 62 are assembled in the accommodating groove 34*b* so as to be rotated together with the rear thick plate 34.

The lock pin 61 possesses a rectangular cross-section and a length chosen so that the lock pin 61 extends continually into a free recess portion 23*d* formed in the outer periphery of the hub portion 23*c* of the rear rotor 23. In other words, this length of the lock pin 61 is set so that the distal end 61*a* of the lock pin 61 is able to extend radially inwardly from the accommodating groove 34*b* even when the lock pin 61 is fully extended until the lock pin 61 reaches the radially outer end of the accommodating groove 34*b*. The radially outward portion of the lock pin 61 is provided with a groove 61*b* which opens in the frontward and radically outward directions. This groove 61*b* receives a portion of the lock spring 62. It is to be noted that the radially outermost end of the accommodating groove 34*b* is open to atomospheric pressure by way of a passage 34*d* to ensure quick or rapid movement of the lock key 61.

The free recess portion 23*d*, having an arc-shaped configuration and extending in the circumferential direction, is adapted to receive the distal end 61*a* of the lock key 61 assuming that relative rotation is allowed between the housing member 30 and the rotor member 20. A stopper surface (first stopper surface) 23*e* is formed at one of the circumferential ends of the free recess portion 23*d* defining the most advanced angular position in which the stopper 23*e* is engaged with the distal end 61*a* of the lock key 61. Along the stopper surface 23*e,* a continual lock recess portion 23*f* is continuously formed. A second stopper surface 23*g* is formed at the other circumferential end of the free recess portion 23*d* which defines the most retarded angular position of the rotor member 20 relative to the housing member 30. The second stopper surface 23*f* is opposed to the stopper surface 23*e*.

The lock spring 62 continually urges the lock key 61 toward the bottom of the free recess portion 23*d* along the radially inward direction of the rear thick plate 34, thus making it possible to move the lock key 61 into the free recess portion 23*d* for accommodation in the sliding mode.

As shown in FIG. 7, the lock recess portion 23*f* is able to receive the distal end 61*a* of the lock key 61 at the most advanced angle such that the lock key 61 cannot be moved in the circumferential direction. A radially extending hole 23*h* which is in fluid communication with the retard angle passage 11 is opened to the bottom of the lock recess portion 23*f*. When operating fluid is supplied to the lock recess portion 23*f* from the retard angle passage 11 by way of the radially extending hole 23*h,* the lock key 61 is moved against the biasing force of the lock spring 62 in the radially outward direction. On the other hand, when operating fluid is drained from the lock recess portion 23*f* to the retard angle passage 11 by way of the radially extending hole 23*h,* the lock key 61 is urged into the lock recess portion 23*f* by the lock spring 62, thereby fitting the distal end 61*a* of the lock pin 61 into the lock recess portion 23*f*.

In accordance with the present invention as described above, while the internal combustion engine is at rest or is stopped, the fluid pump 110 is inoperative and the changeover valve 100 is in the de-energized condition shown in FIG. 1. Thus, the operating fluid supplied to each of the advance angle fluid chambers R1 and the retard angle fluid chambers R2 is returned to the fluid pan 120 by way of the clearances defined between the members as described above.

In addition, upon initiation or starting of the internal combustion engine, the changeover valve 100 is de-energized as shown in FIG. 1. The operating fluid discharged from the fluid pump 110 which begins to operate immediately upon initiation of the internal combustion engine is divided into the advance angle fluid chambers R1 by way of the check valve 130 and the changeover valve 100. In a transition period in which fluid is supplied to each of the advance angle fluid chambers R1 until the pressure of the operating fluid reaches a predetermined value, the lock key 61 may sometimes fail to fit into the lock recess 23*f,* which causes the rotor 20 to rotate relative to the housing member 30. Thus, under such a condition, due to a torque fluctuation (positive or negative counter torque) which is transmitted to the cam shaft 10 from the exhaust valves upon driving thereof, the rotor member 20 and the housing member 30 rotate relative to one another alternately. With the resultant repetitive pressure fluctuations (negative pressure) and the function of the check valve 130 pumping action (suction action), the operating fluid is sucked in a repetitive fashion into the advance angle fluid chambers R1 by way of the check valve 130 and the changeover valve 100 stores or amasses the operating fluid in the advance angle fluid chambers R1.

Figure 8:
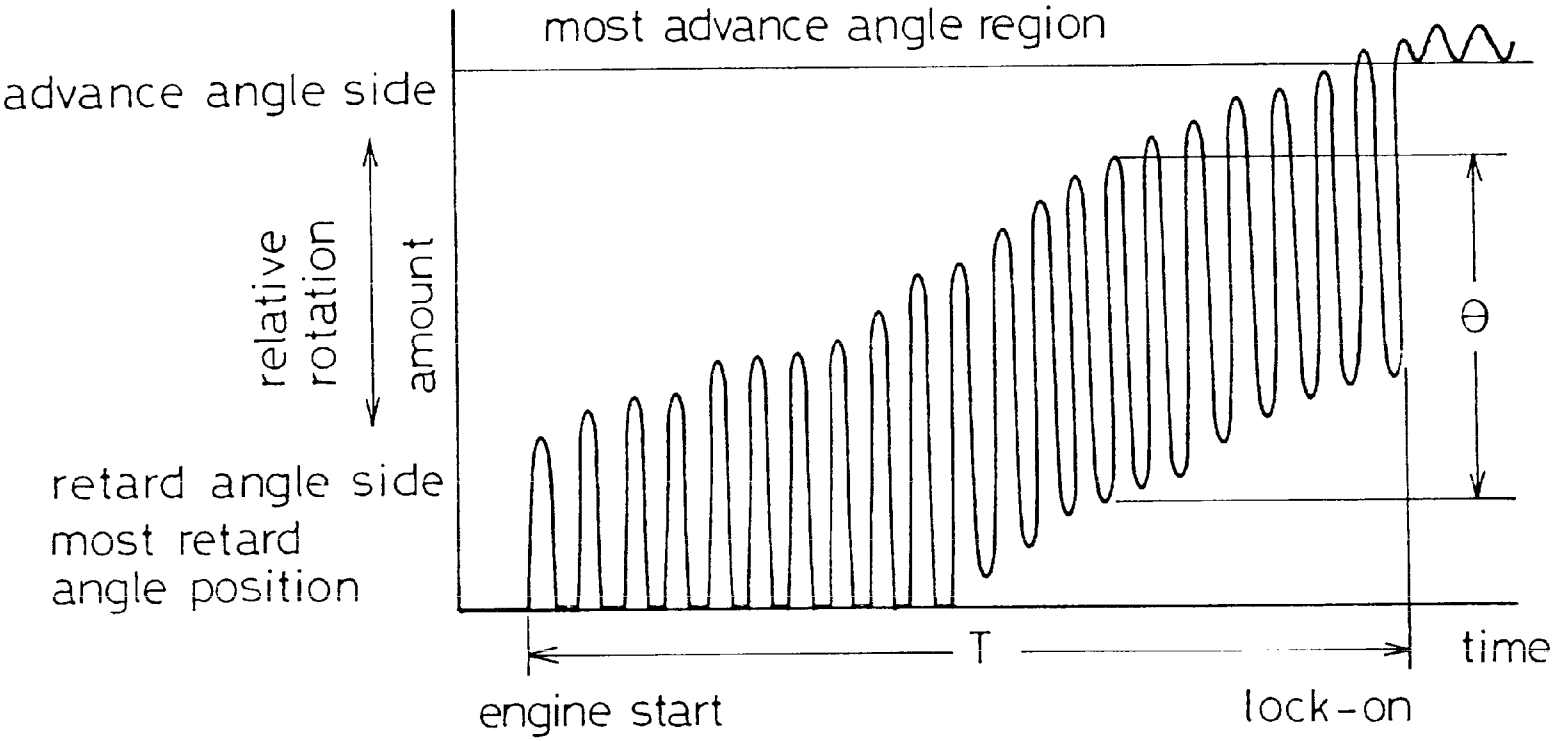
FIG. 8 illustrates the operating characteristics associated with the starting ability of the internal engine with a check valve (a preventing means)
Figure 9:
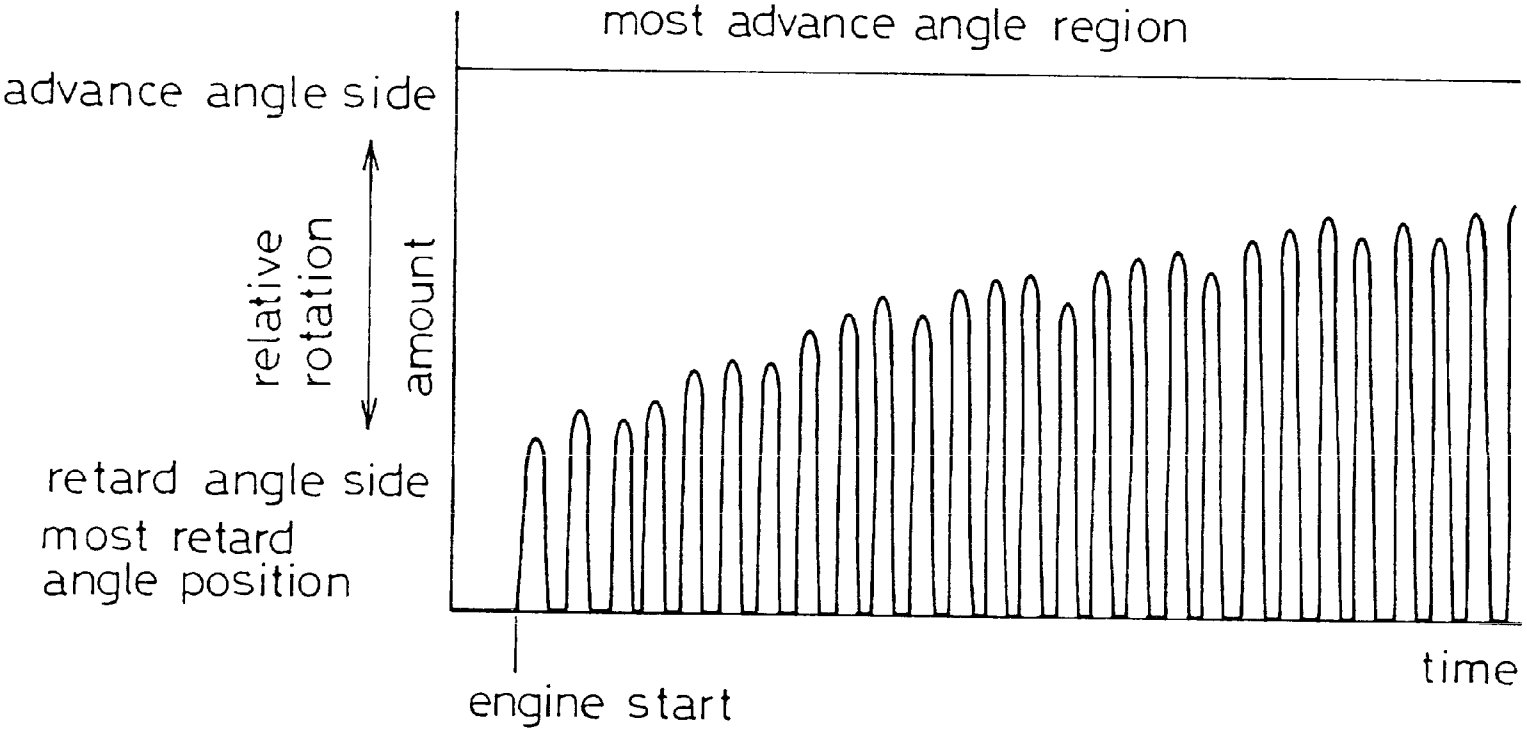
FIG. 9 illustrates the operating characteristics associated with the starting ability of the internal engine without a check valve (a preventing means)

Thus, even though the fluid flow path may possess a high flow resistance ranging from the engine-driven fluid pump 110 to the advance angle fluid chambers R1 and/or the viscosity of the operating fluid is high, as shown in FIG. 8 as the operating fluid is being stored increasingly in the advance angle fluid chambers R1, the rotor member 20 rotates in the advance angle direction relative to the housing member 30 and reaches, in a short time duration T, a region in which the lock mechanism B functions (the most advance angle region). Thus, a substantially immediate beginning of the function or operation of the lock mechanism B (lock-on) is achieved when the internal combustion engine is initiated or started, which makes it possible to optimize (minimize) an overlap duration wherein the intake valves and exhaust valves of the internal combustion engine open concurrently, thereby improving the starting ability of the internal combustion engine.

In addition, in the present invention, due to the fact that the torsion spring S is interposed between the rotor member 20 and the housing member 30 for urging the rotor member 20 in the advance angle direction, in each cycle of relative rotation between the rotor member 20 and the housing member 30 resulting from the torque fluctuation from the exhaust valves to the cam shaft 10 during the aforementioned transition period, the amount of relative rotation θ as seen in FIG. 8 can be increased. This makes it possible to increase the amount of operating fluid per each cycle that is sucked into the advance angle fluid chambers R1 by way of the check valve 130 and the changeover valve 100. It is thus possible to shorten the time of rotation of the rotor member 20 required for reaching the region at which the lock mechanism B functions (the most advance angle region).

As explained above, in the present invention the torsion spring S, which has a spring force or setting load that is small, is employed to increase the relative rotation amount in each cycle. This results in the wire diameter of the torsion spring S being made smaller, thereby enabling the device to be more compact. In addition, this also makes it possible to reduce the operation response difference of the rotation of the rotor member 20 relative to the housing member 30 between when the rotor member 20 is rotated in the advance angle direction and when the rotor member 20 is rotated in the retard angle direction. In this embodiment of the present invention, the set load of the torsion spring S is larger than the average fluctuation torque applied to the cam shaft 10 while the internal combustion engine is in operation to establish that the operation response when the rotor member 20 is rotated in the advance angle direction relative to the housing member 30 is made better than when the rotor member 20 is rotated in the retard angle direction relative to the housing member 30.

In addition, after initiation of the internal combustion engine (i.e. while the internal combustion engine is rotating), when the solenoid 103 of the changeover valve 100 is switched from the de-energized state to the energized state with the application of the second predetermined amount of current, the supply port 106 is brought into fluid communication with the connecting port 101 and the drain port 107 is brought into fluid communication with the connecting port 102. Operating fluid is thus supplied to the retard angle passage 11 and is drained to the fluid pan 120 from the advance angle passage 12. Thus, the operating fluid is supplied to the lock recess portion 23*f* from the retard angle passage 11 by way of the passage 23*h* in the rear rotor 23 and is supplied to the retard angle fluid chamber R2 from the retard angle passage 11 by way of the passage 21*c* in the main rotor 21, whereby the operating fluid is drained from the advance angle fluid chamber R1 to the advance angle passage 12 by way of the passages 21*e* and 21*d* in the main rotor 21.

Therefore, the operating fluid supplied to the lock recess portion 23*f* moves the lock key 61 outwardly in the radial direction against the urging force of the lock spring 62 to escape from the illustrated solid line position (i.e. the distal end 61*a* is extracted or moved out of the lock recess 23*f*) and the operating fluid supplied to the retard angle fluid chamber R2 rotates the rotor member 20 toward the counterclockwise direction in FIG. 4 relative to the housing member 30 from the most advance angle position toward the retard angle side. The resultant relative rotation of the rotor member 20 relative to the housing member 30 can continue until the second stopper surface 23*g* formed on the rear rotor 23 and the distal end 61*a* of the lock key 61 are brought into engagement with each other.

Furthermore, when the solenoid 103 of the changeover valve 100 is switched from the second current amount condition in which the second predetermined amount of current is supplied to the solenoid 103 to the first current amount condition in which the first predetermined amount of current is supplied to the solenoid 103, the supply port 106 and the drain port 107 are both isolated from the connecting ports 101, 102, thus resulting in the operating fluid being retained in the retard angle passage 11 and the advance angle passage 12. This prevents rotation of the rotor member 20 relative to the housing member 30.

When the solenoid 103 of the changeover valve 100 is switched from the first current amount condition to the de-energized condition, the supply port 106 is brought into fluid communication with the connecting port 102 and the connecting port 101 is brought into fluid communication with the drain port 107. As a result, operating fluid is supplied to the advance angle passage 12 and is drained from the retard angle passage 11 to the fluid pan 120. Thus, the operation fluid is supplied from the advance angle passage 12 to the advance angle fluid chamber R1 by way of the passages 21*d* and 21*e* in the main rotor 21, and is drained from the retard angle fluid chamber R2 to the retard angle passage 11 by way of the passage 21*c* in the main rotor 21.

Therefore, the operating fluid supplied to the advance angle fluid chamber R1 rotates the rotor member 20 in the clockwise direction in FIG. 4 relative to the housing member 30 toward the advance angle side. The resulting rotation of the rotor member 20 relative to the housing member 30 can be continued until the stopper surface 23*e* formed on the rear rotor 23 and the distal end 61*a* of the lock key 61 are brought into engagement with each other. At this time, because the drainage of the operating fluid is possible from the lock recess portion 23*f* to the retard angle passage 11, when the rotor member 20 is rotated relative to the housing member 30 towards the most advance angle position at which the distal end 61*a* of the lock member 61 abuts on the stopper surface 23*e* formed on the rear rotor 23, the lock key 61 is urged by the lock spring 62, The distal end 61*a* of the lock key 61 is thus fitted or retracted into and accommodated in the lock recess portion 23*f*.

As is apparent from the foregoing description, the energizing/de-energizing control of the solenoid 103 of the changeover valve 100 makes it possible to adjust the position of the rotor member 20 relative to the housing member 30 at an arbitrary or desired position between the most retard angle position and the most advance angle position, which results in the valve opening and closing operation being made proper while the internal combustion engine is in operation or rotation.

As described above, the stopper mechanism A is made up of the lock key 61, the free recess portion 23*d*, the stopper surfaces 23*e*, 23*g*, the lock recess portion 23*f*, and the lock spring 62, while parts of the lock mechanism B include the lock key 61, the lock recess portion 23*f* and the lock spring 62. The stopper mechanisms A and the lock mechanism B are provided at each of the hub portions of the housing member 30 and the rotor member 20.

More specifically, the lock key 62 is shared by or is common in both the stopper mechanism A and the lock mechanism B. This makes it possible to establish an integrated structure of the stopper mechanism A and the lock mechanism B, whereby the device can be reduced in mass and size.

Thus, the circumferential direction end surfaces of the shoe portion 31*a* of the housing member 30 and the vane portion 21 of the rotor member 20 are not required to be machined and are not required to be of a high strength. The production cost can be reduced or lowered and the vane portion 21 of the rotor member 20 can be made thinner for purposes of miniaturizing the device and reducing the mass.

The stopper surface 23*e* which defines the most advance angle position upon engagement with the distal end 61*a* of the lock key 61 is formed on a circumferential end of the free recess portion 23*d* along which the lock recess portion 23*f* is formed in a continual fashion (i.e. the stopper surface 23*e* and the lock recess portion 23*f* are formed at the common portion of the rear rotor 23.). This makes it possible to more easily obtain with a high degree of precision the position of the lock recess portion 23*f* relative to the most advance angle position. Thus, the productivity in producing the devices can be remarkably increased.

The distal end 61*a* of the lock key 61 projects continually from the accommodating groove 34*b* and a clearance is defined between the lock key 61 and the housing member 30 (i.e., the rear thin plate 33 and the rear thick plate 34) such that sliding rotation therebetween is possible. Thus, the entrance of foreign material into the clearance is rare, thereby increasing the operational reliability of the device.

The stopper surface 23*g* which defines the most retard angle position of the rotor member 20 relative to the housing member 30 is formed on the circumferential end of the free recess portion 23*d* which opposes the stopper surface 23*e*. This makes it possible to relatively easily obtain with high precision the circumferential length of the lock recess portion 23*d*. Thus, the maximum rotation amount of the rotor member 20 relative to the housing member 30 can be set with higher precision.

Also, adjusting the circumferential length of the free recess portion 23*d* which is formed in the rear rotor 23 makes it possible to set the maximum relative rotation at an arbitrary or desired value. Thus, different devices can be easily produced for different internal combustion engines by simply replacing or varying the rear rotor 23, and other elements such as the housing member 30 can be shared by the varying devices.

Figure 10:
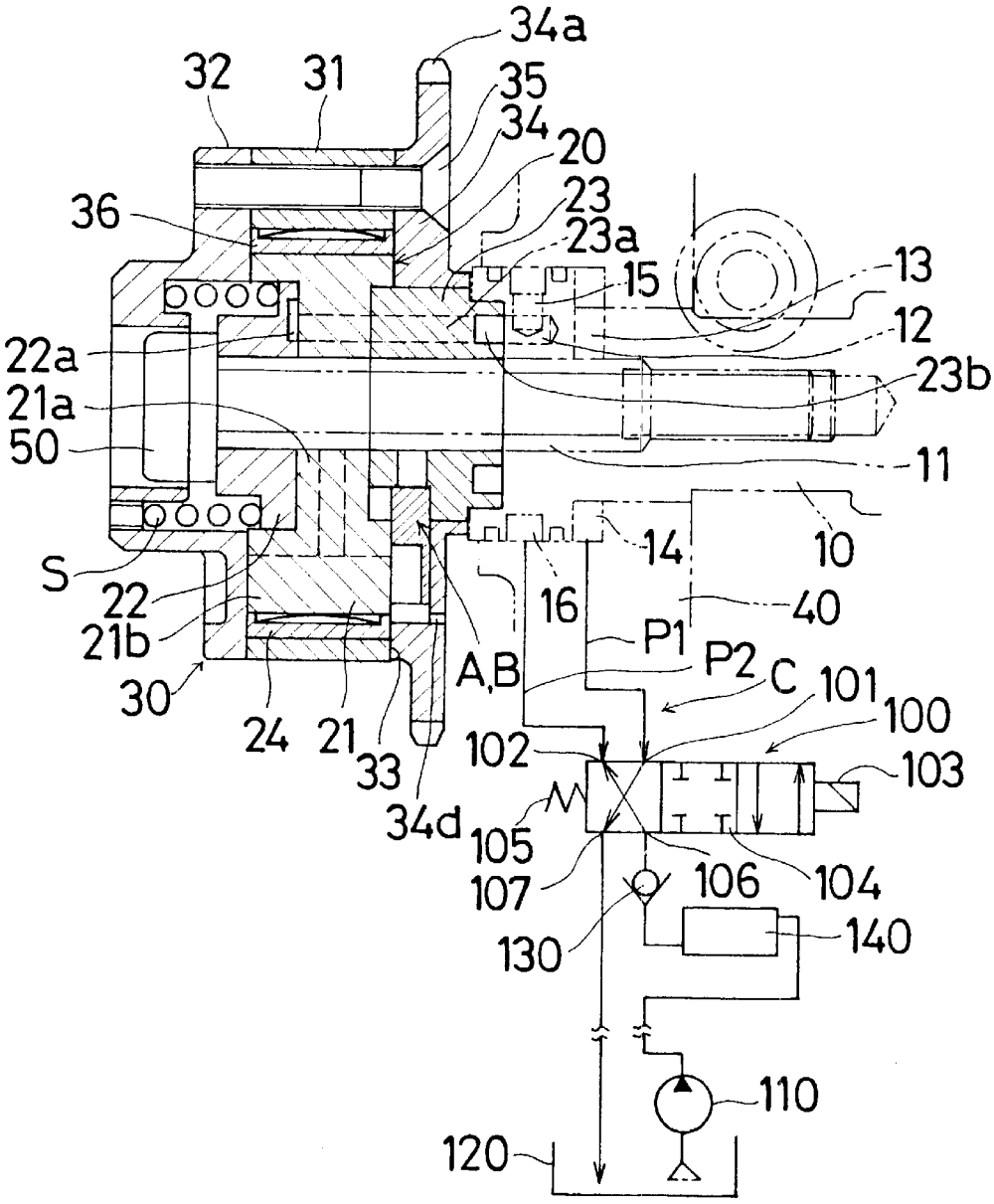
FIG. 10 is a cross-sectional view of a valve timing regulation device in accordance with a second embodiment of the present invention.

FIG. 10 illustrates a second embodiment of a valve timing regulation device in accordance with the present invention. In this embodiment, a fluid reservoir 140 is disposed between a check valve 130 and a fluid pump 110. An amount of operating fluid is always stored in the fluid reservoir 140 and the fluid reservoir 140 is close to the check valve 130. Thus, the sucking pressure during the foregoing pumping operation can be made smaller, which makes it possible to smoothly suck or draw in the operating fluid into the advance angle fluid chamber RI by way of the check valve 130 and the changeover valve 100.

In the foregoing embodiments, although the lock key 61 is assembled into the housing member 30, other lock members such as a lock pin can be used instead of the lock key 61, or the lock key 61 and variations thereof can be assembled to the rotor member 20.

In the foregoing embodiments, the lock member or key 61 is designed to lock/unlock by sliding in the radial direction. An alternative structure can be employed wherein the lock member or key 61 is designed to lock/unlock by sliding in the axial direction. In such a case, the lock recess portion has to be arranged in the axial direction for receiving the distal end of the lock member so as not to be immovable at the most retard angle position.

In the embodiments described above, the rotor member 20 and the housing member 30 are assembled to the side of the cam shaft 10 and the side of the crankshaft, respectively. However, the rotor member 20 and the housing member 30 can also be assembled to the side of the crankshaft and the side of the cam shaft 10, respectively.

In both the stopper mechanism A and the lock mechanism B described above, the lock key 61 connects the rear thick plate 34 of the housing member 30 and the rear rotor 23 of the rotor member 20. The present invention is not restricted to this structure. For example, the lock key 61 can be made to connect the housing member 30 and the cam shaft 10, and the result exhibits the same operation as that described above.

As described above, the lock mechanism B is designed to operate (lock/unlock) at the most advance angle position. As an alternative, the lock mechanism B can be made to operate at the most retard angle position and the valve timing regulating device disposed with a cam shaft controlling opening and closing of the intake valve.

In accordance with the present invention, in the transition period in which the pressure of the operating fluid outputted from the fluid pump (fluid pressure supplying means) toward the retard angle fluid chamber increases to the predetermined value when the internal combustion engine is initiated, the torque fluctuation transmitted from the valve to the driven shaft (and the rotor member) causes the relative rotation between the housing member and the rotor member repetitiously. Thus the vane (the dividing member) causes a change in the volume of the advance and retard angle fluid chambers repetitively. The resultant, repetitive pressure (negative pressure) changes in the retard angle fluid chamber and the function of the check valve (the preventing means) preventing the operation fluid from being drained from the retard angle fluid chamber to the fluid pump (the fluid supplying means), establishes pumping action (sucking action), which results in repetitive suctions of the operating fluid into the retard angle fluid chamber by way of the check valve (the preventing means) and the control valve (the regulating member), thereby storing the operating fluid in the retard angle fluid chamber in a stepwise manner.

In addition, in cases where the torque assist mechanism is interposed between the housing member and the rotor member for urging the rotor member fixed to the driven shaft in the advanced angle direction to the housing member fixed to the driving shaft, and where the set load of the torsion spring S is made larger than the average fluctuation torque applied to the cam shaft, the operation response, when the rotor member is rotated in the advance angle direction relative to the housing member, is made better or improved relative to when the rotor member is rotated in the retard angle direction relative to the housing member, while the internal combustion engine is in operation.

Furthermore, when the operating fluid reservoir in which the operating fluid is stored is disposed between the check valve (the prevent means) and the fluid pump (the fluid pressure supplying means) in such a manner that the fluid reservoir is placed close to the check valve (the preventing means), the substantial sucking head can be made smaller. This thus establishes a smooth sucking of operating fluid into the retard angle fluid chamber by way of the check valve (the preventing means) and the control valve (the regulating member).

Furthermore, when the preventing means is provided between the regulating member and the fluid pressure supplying means in such a manner that the preventing means is the check valve (the one way valve), it can simplify the fluid circuit and reduce the product cost of the valve timing regulating device.

The housing member and the rotor member can be operated to lock and unlock each other at an intermediate position between the most advance angle region and the most retard angle region. A relative rotation position of the rotor member against the housing member is detected when or during when the valve timing regulation device is not operated. When the rotor member is located at a more advance angle region than the intermediate position, the preventing means is located between the retard angle fluid chamber and the fluid pressure supplying means. When the rotor member is located at a more retard angle region than the intermediate position, the preventing means is located between the advance angle fluid chamber and the fluid pressure supplying means. The changeover valve achieves this changeover of the location of the preventing means. This embodiment permits realization of advantages similar to those mentioned above.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve timing regulation device comprising:

a housing member positioned in a driving force transmission path in which a driving force is transmitted from a driving shaft of an internal combustion engine to a driven shaft for opening and closing a valve of the internal combustion engine, the housing member being rotatable together with one of the driving shaft and the driven shaft;

a rotor member assembled to a shoe portion of the housing member and rotatable relative thereto, the rotor member having a vane portion dividing an interior of the housing member into an advance angle fluid chamber and a retard angle fluid chamber, the rotor member being rotatable together with the other of the driving shaft and the driven shaft;

a lock mechanism which alternatively permits and prevents relative rotation between the housing member and the rotor member;

a fluid pressure circuit controlling supply and drainage of an operating fluid to and from each of the advance angle fluid chamber and the retard angle fluid chamber, the fluid pressure circuit including a fluid pump driven by the internal combustion engine, a control valve which controls, by adjustment of the operating fluid supplied from the fluid pump, the supply and drainage of the operating fluid to and from each of the advance angle fluid chamber and the retard angle fluid chamber, the control valve controlling the lock and unlock of the lock mechanism, a check valve disposed between the control valve and the fluid pump for preventing entrance of the operating fluid into the fluid pump, the check valve being connected to the control valve by only a single line that is devoid of an accumulator; and the lock mechanism permitting relative rotation between the housing member and the rotor member during a transition period in which fluid pressure supplied to one of the advance angle fluid chamber and the retard angle fluid chamber from the fluid pump increases to a predetermined value when the internal combustion engine is started, and preventing relative rotation between the housing member and the rotor member at one of the most advance angle position and the most retard angle position after the transition period.

2. The valve timing regulation as set forth in claim 1, further comprising a torque assist mechanism interposed between the housing member and the rotor member for urging the driven shaft to advance relative to the driving shaft and for urging the rotor member toward the housing member.

3. The valve timing regulation device as set forth in claim 1, wherein a fluid reservoir in which is continually stored the operating fluid is disposed between the check valve and the fluid pump such that the fluid reservoir is placed close to the check valve.

4. A valve timing regulating device comprising:

a housing member, a rotor member, a chamber disposed between the housing member and the rotor member, a dividing member dividing the chamber into an advance angle fluid chamber and a retard angle fluid chamber, fluid pressure supplying means for supplying an operation fluid to the advance angle fluid chamber and/or the retard angle fluid chamber respectively, a regulating member for regulating the operation fluid supplied to the advance angle fluid chamber and/or the retard angle fluid chamber, and preventing means for preventing the operating fluid from being drained from one of the advance chamber or the retard chamber, the preventing means causing relative rotation between the housing member and the rotor member to establish a pumping action.

5. The valve timing regulation device as set forth in claim 4, including a fluid reservoir disposed between the preventing means and the fluid pressure supplying means, the fluid reservoir continually storing some of the operating fluid and being located close to the preventing means.

6. The valve timing regulating device as set forth in claim 4, further comprising a torque assist mechanism interposed between the housing member and the rotor member for urging one of the housing member and the rotor member to advance relative to the other of the housing member and the rotor member.

7. The valve timing regulating device as set forth in claim 4, wherein the preventing means is disposed between the regulating member and the fluid pressure supplying means.

8. The valve timing regulating device as set forth in claim 4, further comprising a lock member preventing relative rotation between the housing member and the rotor member at the most advance angle position, and a cam shaft which controls opening and closing of an exhaust valve.

9. The valve timing regulating device as set forth in claim 5, further comprising a lock member preventing relative rotation between the housing member and the rotor member at the most advance angle position, and a cam shaft which controls opening and closing of an exhaust valve.

10. The valve timing regulating device as set forth in claim 6, further comprising a lock member preventing relative rotation between the housing member and the rotor member at the most advance angle position, and a cam shaft which controls opening and closing of an exhaust valve.

11. The valve timing regulating device as set forth in claim 7, further comprising a lock member prevents relative rotation between the housing member and the rotor member at the most advance angle position, and a cam shaft which controls opening and closing of an exhaust valve.

12. The valve timing regulating device as set forth in claim 4, further comprising a lock member preventing relative rotation between the housing member and the rotor member at the most retard angle position, and a cam shaft which controls opening and closing of an intake valve.

13. The valve timing regulating device as set forth in claim 5, further comprising a lock member preventing relative rotation between the housing member and the rotor member at the most retard angle position, and a cam shaft which controls opening and closing of an intake valve.

14. The valve timing regulating device as set forth in claim 6, further comprising a lock member preventing relative rotation between the housing member and the rotor member at the most retard angle position, and a cam shaft which controls opening and closing of an intake valve.

15. The valve timing regulating device as set forth in claim 7, further comprising a lock member preventing relative rotation between the housing member and the rotor member at the most retard angle position, and a cam shaft which controls opening and closing of an intake valve.

16. The valve timing regulating device as set forth in claim 4, further comprising a lock member preventing relative rotation between the housing and the rotor members at an intermediate position between the most advance angle position and the most retard angle position, the preventing means preventing flow of the operation fluid from the advance and retard angle chambers to the fluid supplying means when the rotor member is located towards the most retard and advance angle position relative to the intermediate position.

17. The valve timing regulating device as set forth in claim 16, including a cam shaft which controls opening and closing of an intake valve.

18. The valve timing regulating device as set forth in claim 16, including a cam shaft which controls opening and closing of an exhaust valve.

19. A valve timing regulation device comprising:

a housing member positioned in a driving force transmission path in which a driving force is transmitted from a driving shaft of an internal combustion engine to a driven shaft for opening and closing a valve of the internal combustion engine, the housing member being rotatable together with one of the driving shaft and the driven shaft;

a rotor member positioned within the housing and rotatable together with the other of the driving shaft and the driven shaft to rotate relative to the housing, the rotor member including a plurality of vane portions dividing an interior of the housing member into a plurality of advance angle fluid chambers and a plurality of retard angle fluid chambers;

a lock mechanism which alternatively permits and prevents relative rotation between the housing member and the rotor member; and a fluid pump driven by the internal combustion engine to pump operating fluid into the advance angle fluid chambers and the retard angle fluid chambers;

a control valve positioned between the pump and the advance and retard angle fluid chambers to control supply and drainage of the operating fluid to and from each of the advance and retard angle fluid chambers;

a check valve disposed between the control valve and the fluid pump at a location closer to the control valve than the fluid pump to prevent entrance of the operating fluid into the fluid pump; and the lock mechanism permitting relative rotation between the housing member and the rotor member during a transition period in which fluid pressure supplied to one of the advance angle fluid chamber and the retard angle fluid chamber from the fluid pump increases to a predetermined value when the internal combustion engine is started, and preventing relative rotation between the housing member and the rotor member at one of the most advance angle position and the most retard angle position after the transition period.

* * * * *